US005635223A

United States Patent [19]

Korsch et al.

[11] Patent Number: 5,635,223

[45] Date of Patent: Jun. 3, 1997

[54] DEVICE FOR FIXING THE DIES IN THE DIE TABLE OF TABLETTING MACHINES

[75] Inventors: Wolfgang Korsch; Peter Sommerfeld, both of Berlin, Germany

[73] Assignee: Korsch Pressen GmbH, Berlin, Germany

[21] Appl. No.: 417,029

[22] Filed: Apr. 5, 1995

[51] Int. Cl.[6] ..... B30B 15/02

[52] U.S. Cl. ..... 425/193; 425/195; 425/345; 425/353

[58] Field of Search ..... 83/698.91, 552, 83/698.41, 698.51, 549, 618; 403/256, 261; 72/442, 481.2; 100/260, 266, 903, 907; 425/182, 193, 195, 345, 353

[56] References Cited

U.S. PATENT DOCUMENTS

| | | | |
|---|---|---|---|
| 2,989,781 | 6/1961 | Frank | 425/193 |
| 4,764,241 | 8/1988 | Makino | 425/345 |
| 5,004,413 | 4/1991 | Stopforth | 425/193 |

FOREIGN PATENT DOCUMENTS

| | | | |
|---|---|---|---|
| 1164913 | 3/1964 | Germany | 425/182 |
| 1454820 | 3/1969 | Germany . | |
| 3003238 | 8/1981 | Germany . | |

*Primary Examiner*—C. Scott Bushey
*Attorney, Agent, or Firm*—McGlew and Tuttle

[57] ABSTRACT

A device for fixing the dies in the die table of a tabletting machine, especially of a rotary tabletting machine, using die holders. To make it possible to rapidly remove the old dies and to rapidly fix the new dies during the replacement of the dies for cleaning the machine, the die holders are arranged between the rotor axis and the pitch circle of the dies, and structure is provided for jointly moving the die holders on the die table.

9 Claims, 6 Drawing Sheets

DEVICE FOR FIXING THE DIES IN THE DIE TABLE OF TABLETTING MACHINES

FIELD OF THE INVENTION

The present invention pertains to a device for fixing the dies in the die table of a tabletting machine, especially of a rotary tabletting machine, by means of die holders.

BACKGROUND OF THE INVENTION

Modern tabletting machines are suitable for pressing tablets of a great variety of types and shapes. After one batch or a plurality of batches of tablets have been manufactured, the press molds must be removed for cleaning and subsequently mounted. Disassembly is also necessary when the machine is retrofitted from one tablet format to another tablet format. To do so, the punches and dies must be replaced. Tabletting machines, in which the dies are fixed and locked or can be detached by means of die screws, which are screwed into the die table from the outside, have been known. As many die screws are needed as there are dies. The die screws are conical at the front end and engage circumferential grooves of the dies with the conical end during screwing in for fixing the dies. Every individual die screw must be removed manually one after the other at the time of replacement in order to remove the dies of the old batch. After removal of the old dies and insertion of the new dies, all die screws must again be tightened one by one manually for fixing and locking. This time-consuming process of die replacement is unsatisfactory especially in the case of smaller batches, because the time requirement for replacing the dies means machine downtime. However, high operating times should be reached precisely with modern machines, which have a considerable investment value.

SUMMARY AND OBJECTS OF THE INVENTION

The basic object of the present invention is therefore to provide a device with which both rapid removal of the old dies and rapid fixation of the new dies in the die table are possible.

According to the invention, a device for fixing the dies in the die table of a tabletting machine is provided. The tabletting machine is particularly a rotary tabletting machine. Die holders are provided arranged between a rotor axis and a pitched circle of the dies. Die holder moving means is provided for moving the die holders together (in unison). The die holder moving means is provided on the die table. Rapid and simple replacement of the dies is made possible by the use according to the present invention of a device for the joint movement of the die holders in the die table and by the arrangement of the die holders of the die table between two dies, which are arranged on the reference circle of the die table.

The die holders are arranged in holes that are radial in relation to the rotor axis. The die holder movement means is preferably designed as a hydraulic device and the die holders are designed as hydraulic pistons with conical heads. Screw plugs are provided with springs, the plugs being screwed into radial holes on the outer edge of the die table. Die pins, which press the springs of the screw plugs, are arranged at the die holders.

The die holders may also be designed as cams on a ring disc mounted in the die table. Further, the die holders may be designed as circle segments movable radially from the inside toward the dies and a ring disc, which is mounted in the die table and engages obliquely positioned elongated holes of the circle segments with pins, is also provided. The ring disc is driven by means of a piston.

The die holders are preferably designed as lever pairs which are expanded by spring elements that are mounted and pivotable in the die table. The levers can be actuated by push rods wherein pressure can be emitted radially from the inside.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
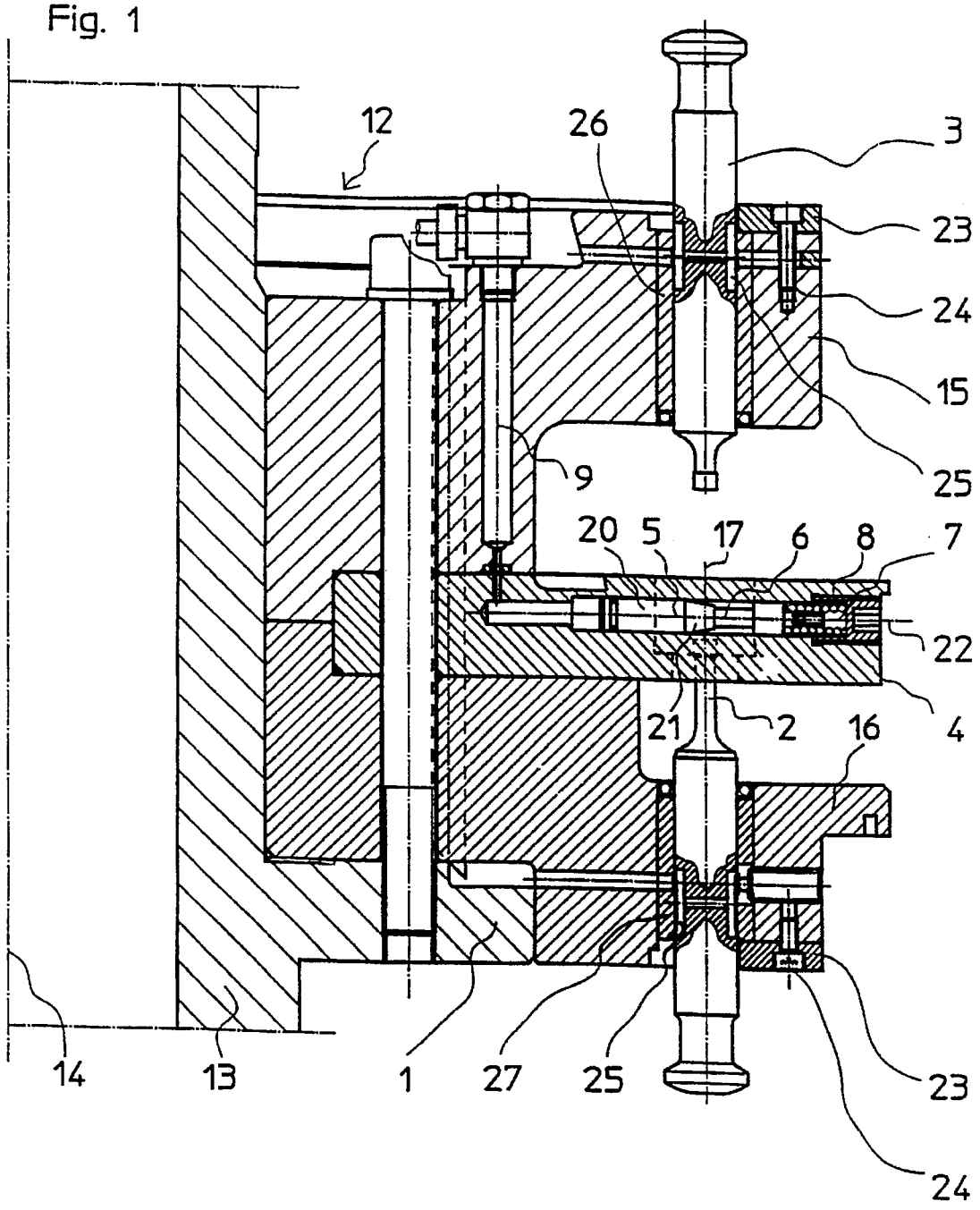
FIG. 1 is a vertical partial sectional view through a rotary tabletting machine.
Figure 1A:
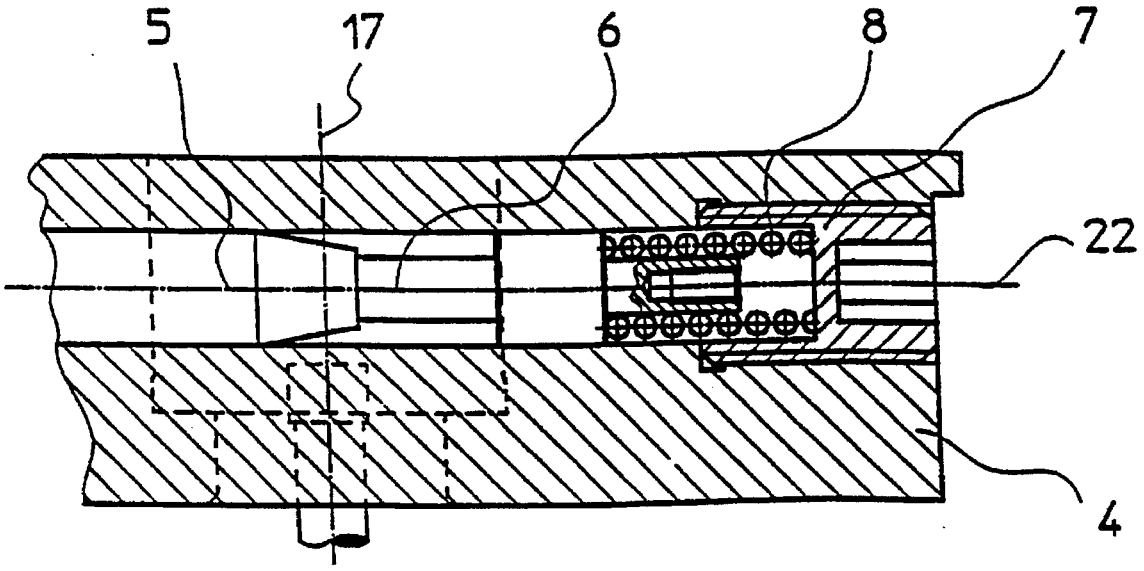
FIG. 1A is an enlarged partial sectional view of the die holder assembly of FIG. 1.

FIG. 1 shows a vertical partial section through a rotary tabletting machine 12. This machine is comprised of a die table 4, which is connected to a rotor 1, which is driven via a drive shaft 13 rotating around a vertical rotor axis 14, and is formed by a rotor upper part 15 and a rotor lower part 16, in which respective upper punches 3 and lower punches 2 are guided. The upper punch 3 is adjusted by means of a guide sleeve 26, which is designed with a groove, as well as by means of a feather key 25. The guide sleeve 26 of the upper punch 3 is fastened with an adapter 23 with an associated screw 24. The lower punch 2 is also adjusted by means of a guide sleeve 27 and a feather key 25. The lower punch 2 located in the guide sleeve 27 is fastened by means of an adapter 23 and a screw 24. In the die table 4, dies 10 are uniformly arranged on the reference circle 17 of the die table 4. When the die table 4 rotates during the operation of the rotary tabletting machine 12, the dies 10 with the upper punches 3 and lower punches 2 belonging to them consecutively reach a pressing station, where the filling material contained in the die 10 is pressed into the finished tablet by means of pressure rollers. The pressing station and the pressure rollers are not shown in FIG. 1. The same applies to the filling shoes, whose task it is to fill the filling material after the pressing process into the now empty die 10.

Each die 10 is comprised of a metallic die body 18 and a through hole 19, which forms the mold for pressing the tablet and has an annular groove 11 on its outer circumference. The die holder 5 is designed as a hydraulic piston 20 with a conical clamping head 21 and is provided with an extended die pin 6, which presses a spring 8 of a screw plug 7. The latter is securely screwed into the radial hole 22 in the die table 4 from the outside. The pressing force of a hydraulic device, not shown, is simultaneously transmitted to the piston-like die holder 5 by a pressure feed means 9 guided by the rotor 1.

Figure 2:
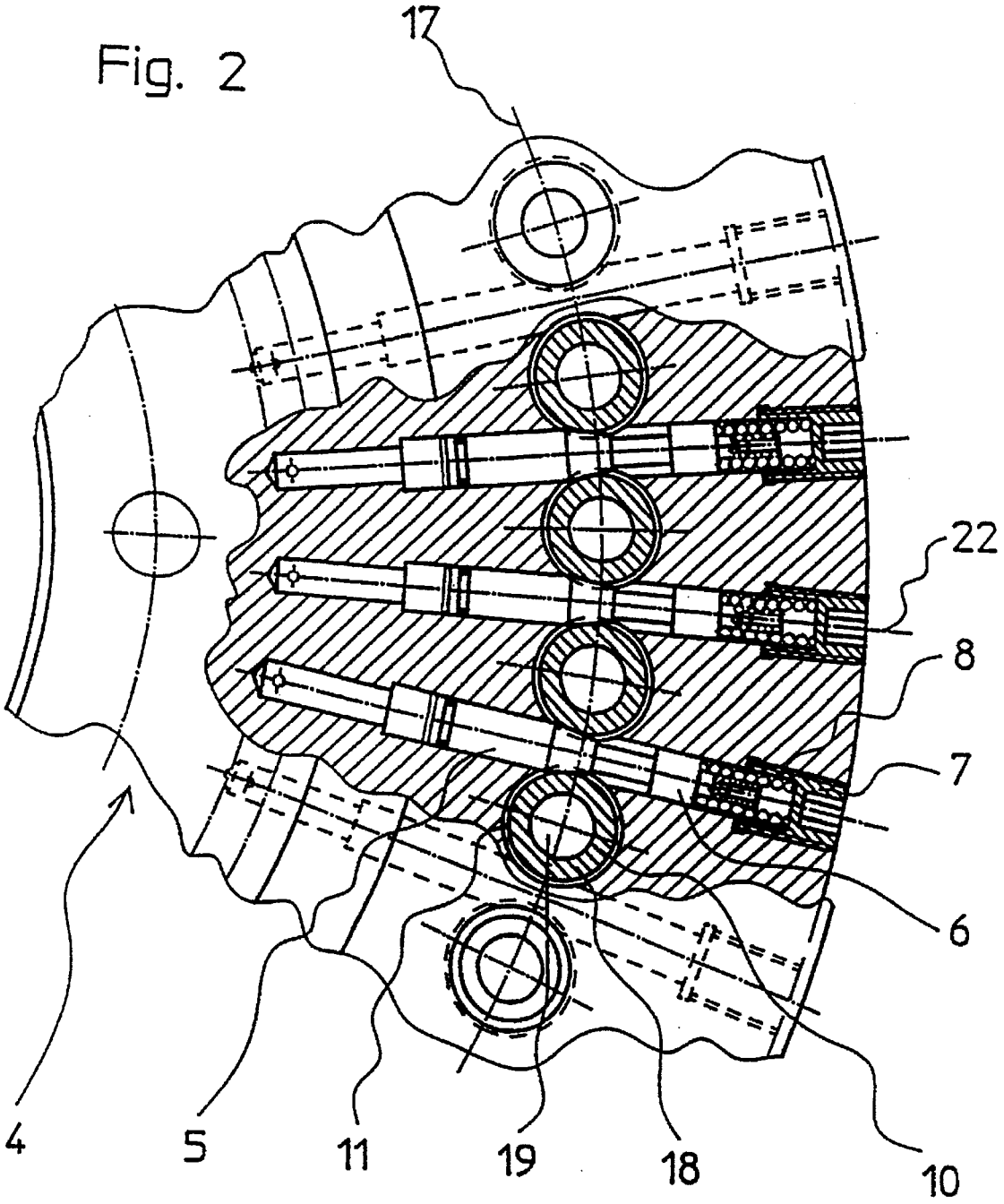
FIG. 2 is a partially cutaway partial top view of the die table.

FIG. 2 shows a partial top view of the die table 4. The dies 10 are uniformly distributed on the reference circle 17. The die holders 5 are designed as hydraulic pistons 20, at the ends of which the die pins 6 are arranged. The conical clamping head 21 of the die holder 5 engages the annular grooves 11 of the dies 10 during fixation. Two die holders 5 thus wedge in a die 10 such that it is secured against vertical and axial displacements during the pressing process. Since one die holder 5 engages annular grooves 11 of the dies 10 arranged to the left and right of it, the number of die holders 5 needed equals that of the dies. The screw plugs 7 are screwed from the outside into the die table 4. The screw plugs are provided with springs 8. These screw plugs 7 are located in the same radial holes 22 as the die holders 5 belonging to them. During the fixation process, the die pins 6 of the die holders 5 press the springs 8 of the screw plugs 7, so that the springs 8 are compressed after the fixation process. If the dies 10 are to be replaced, the hydraulic means is switched off, so that no more force is exerted on the die holders 5 in the direction of the dies 10 via the pressure feed means 9. However, the die holders 5 must be moved away from the dies 10 in order to remove the dies 10. The springs 8 of the screw plugs 7, which are compressed during the fixation, are released and press the die holders 5 radially in the inward direction from the dies 10. This happens simultaneously for all dies 10. The dies 10 can then be removed from the die table 4, the new dies 10 can be inserted, and simultaneously fixed by means of the hydraulic means. This facilitates and expedites the cleaning process of the machines and the die replacement.

Figure 3:
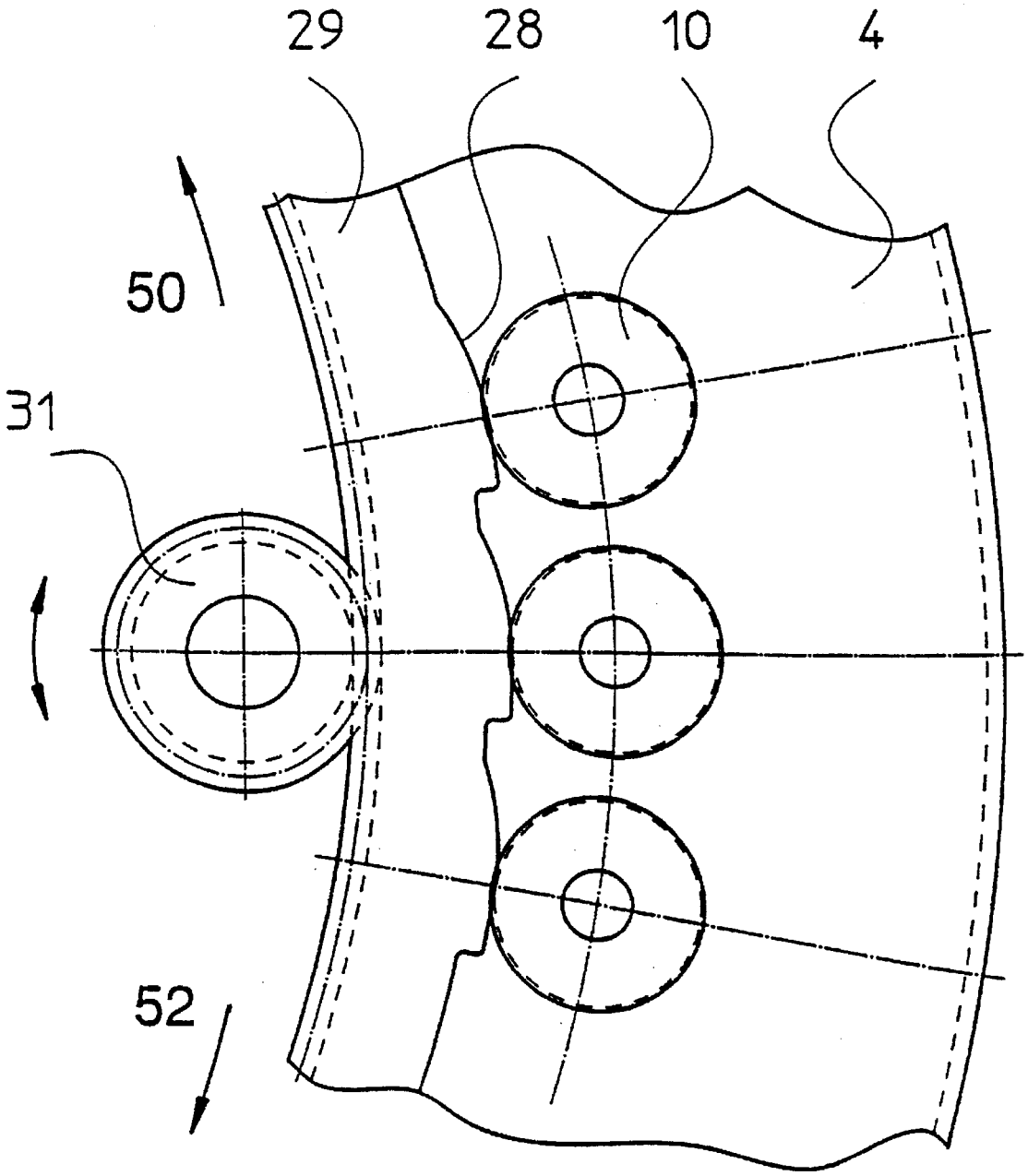
FIG. 3 is a partially cut away partial top view of the die table according to another embodiment of the invention.

Another embodiment for central fastening of the dies 10 consists of designing the die holders 5 as cams 28 on a ring disk 29 mounted in the die table 4, which is driven via, e.g., a pinion 31 (see FIG. 3). Rotation of the pinion 31 in one direction 50 results in fixing the die and rotation of the die in the opposite direction 52 results in loosening the die.

Figure 4:
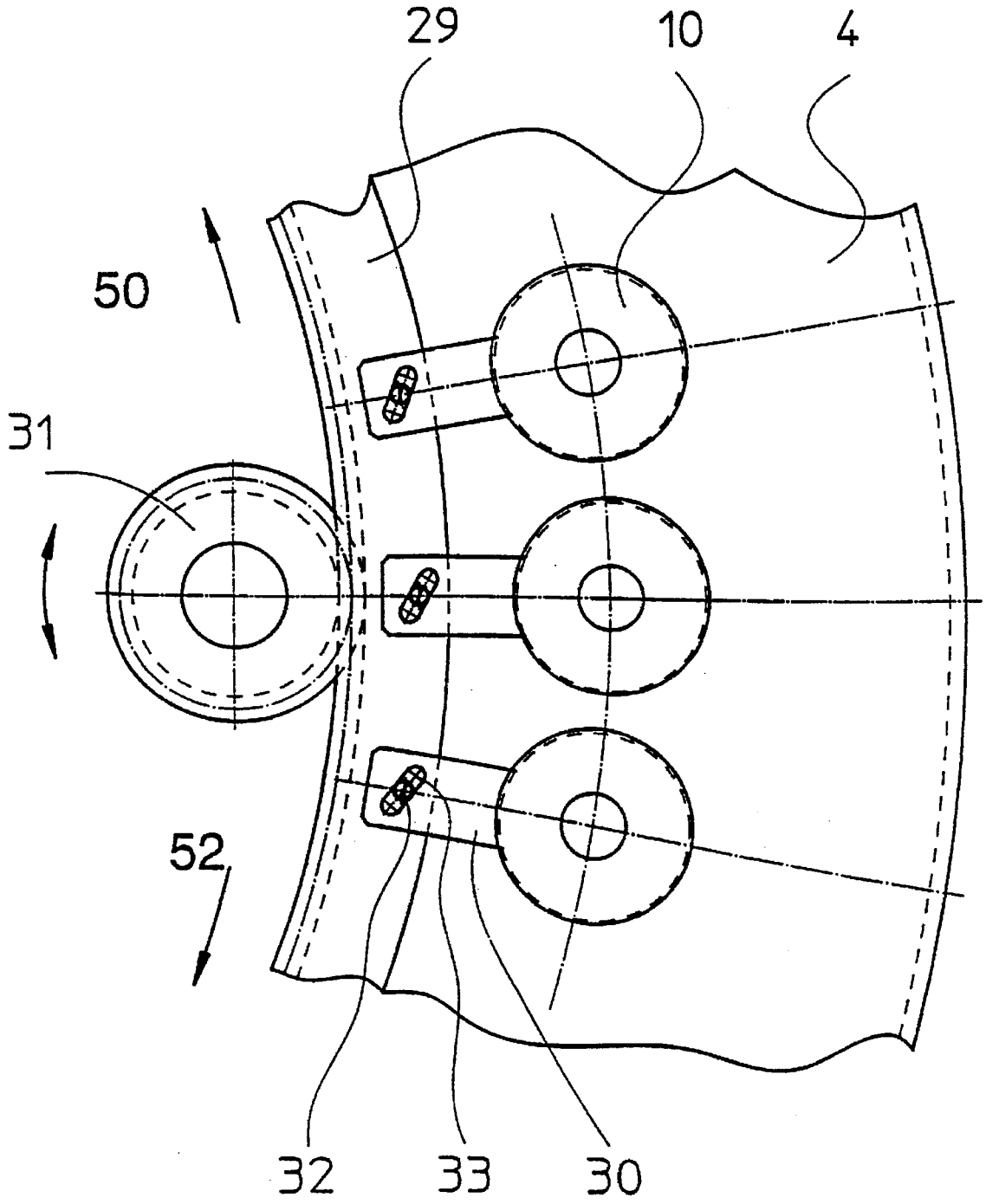
FIG. 4 is a partially cut away partial top view of the die table according to another embodiment of the invention.
Figure 5:
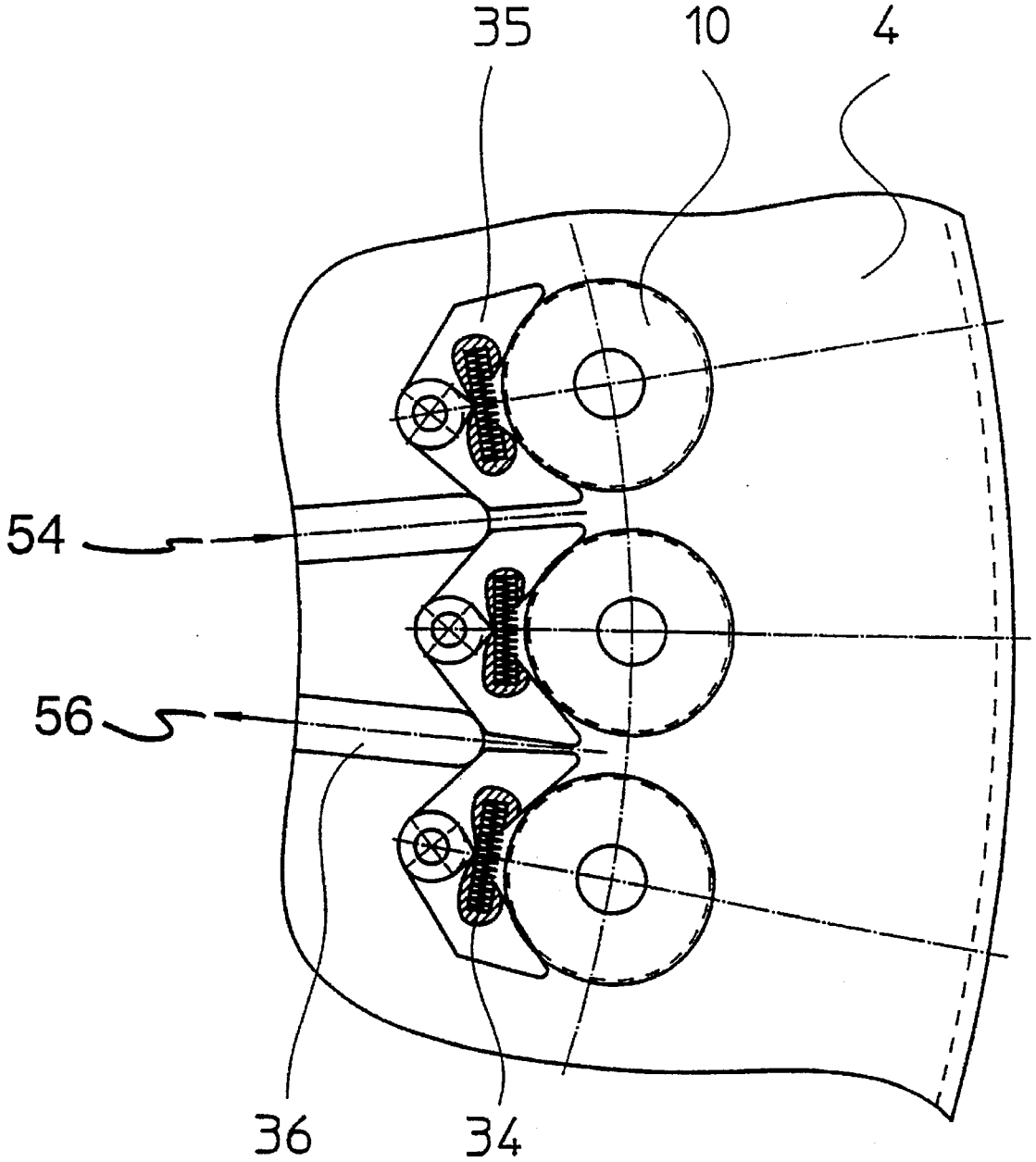
FIG. 5 is a partially cut away partial top view of still another embodiment of the invention.

Another mechanical embodiment is the design of the die holders 5 as lever pairs 35 which are expanded by spring elements and 34 are mounted and pivotable in the die table 4. The levers are actuated by push rods 36 to which pressure can be admitted radially from the inside (see FIG. 5). Movement of the push rods 36 in one direction 54 results in fixing the die and movement of the push rods 36 in the opposite direction 56 results in loosening the die. It is also possible to design the die holders 5 as circle segments 30 movable radially from the inside toward the dies 10. The circle segments 30 are provided with obliquely positioned elongated holes 33. A ring disk 29 mounted in the die table 4, which is driven by, e.g., a pinion 31, then engages the obliquely positioned elongated holes of the circle segments with pins 32 during the fastening process (see FIG. 4). Rotation of the pinion 31 in one direction 50 results in fixing the die and rotation of the die in the opposite direction 52 results in loosening the die.

While specific embodiments of the invention have been shown and described in detail to illustrate the application of the principles of the invention, it will be understood that the invention may be embodied otherwise without departing from such principles.

What is claimed is:

1. Device for fixing dies in a die table of a rotary tabletting machine, comprising: dies provided in a pitched circle; die holders arranged between a rotor axis and said pitched circle of dies; and die holder movement means for moving said die holders substantially simultaneously, said die holder movement means being provided on said die table.

2. Device according to claim 1, wherein said die holders are arranged in holes that are radial in relation to said rotor axis.

3. Device according to claim 1, wherein said die holder movement means includes a hydraulic device, said die holders being designed as hydraulic pistons with conical heads.

4. Device according to claim 3, wherein said die holder movement means includes screw plugs provided with springs, said screw plugs being screwed into radial holes on an outer edge of said die table and die pins, which press said springs of said screw plugs, are arranged at said die holders.

5. Device according to claim 1, wherein said die holder movement means includes die holders designed as cams on a ring disc mounted in said die table.

6. Device according to claim 1, wherein said die holder movement means includes die holders formed as circle segments movable radially from an inside toward said dies, and a ring disc which is mounted in said die table and engages obliquely positioned elongated holes of said circle segments with pins.

7. Device according to claim 5, wherein said ring disc is driven by means of a pinion.

8. Device according to claim 6, wherein said ring disc is driven by means of a pinion.

9. Device according to claim 1, wherein said die holders are designed as lever pairs which are expanded by said spring elements and are mounted pivotable in said die table, said levers being actuated by push rods driven by a hydraulic device supplying pressure emitted radially from the inside.

* * * * *